United States Patent [19]

Verney-Carron

[11] Patent Number: 4,646,457

[45] Date of Patent: Mar. 3, 1987

[54] BARREL AND INTERCHANGEABLE TRIGGER PLATE LOCKING DEVICE FOR SHOT GUNS

[75] Inventor: Claude Verney-Carron, Saint-Etienne, France

[73] Assignee: Verney-Carron S.A., France

[21] Appl. No.: 600,136

[22] Filed: Apr. 13, 1984

[30] Foreign Application Priority Data

Apr. 20, 1983 [FR] France ..... 83 06869

[51] Int. Cl.[4] ..... F41C 7/00; F41C 19/00; F41C 11/04

[52] U.S. Cl. ..... 42/41; 42/44; 42/42.01

[58] Field of Search ..... 42/40–45

[56] References Cited

U.S. PATENT DOCUMENTS

| | | | |
|---|---|---|---|
| 418,951 | 1/1890 | Jensen | 42/44 |
| 452,126 | 5/1891 | Torkelson | 42/41 |
| 817,764 | 4/1906 | Gruver | 42/40 |
| 1,998,596 | 4/1935 | Stiennon | 42/41 |
| 3,276,158 | 10/1966 | Johnston | 42/41 |
| 3,766,677 | 10/1973 | Waddell | 42/75 D |
| 4,315,377 | 2/1982 | Jenkins | 42/42 R |

FOREIGN PATENT DOCUMENTS

| | | | |
|---|---|---|---|
| 338088 | 12/1926 | France . | |
| 705275 | 6/1931 | France | 42/44 |
| 8462 | of 1911 | United Kingdom | 42/41 |

*Primary Examiner*—Deborah L. Kyle
*Assistant Examiner*—Michael Carone
*Attorney, Agent, or Firm*—Eric P. Schellin

[57] ABSTRACT

An interchangeable trigger device comprising a standard trigger plate, allowing indifferently the mounting of a single selective trigger or of separate triggers. The plate comprises a flat base which can be fitted by pivoting into the opening of the receiver tang and a boss (1*c*) with a front lug (1*d*) to co-operate with the rear part of a double-acting sliding bolt (22), the front of which (22*a*) co-operates with the breech (23) when closing the gun; a top lever (14) actuating the sliding bolt (22) through an eccentric, for sliding it longitudinally according to three positions, a pivoting lever (24) with front stepped notches, and a double-acting elastic return means co-operating with the front nose of the bolt (22) for maintaining it in these positions.

11 Claims, 14 Drawing Figures

Fig. 6
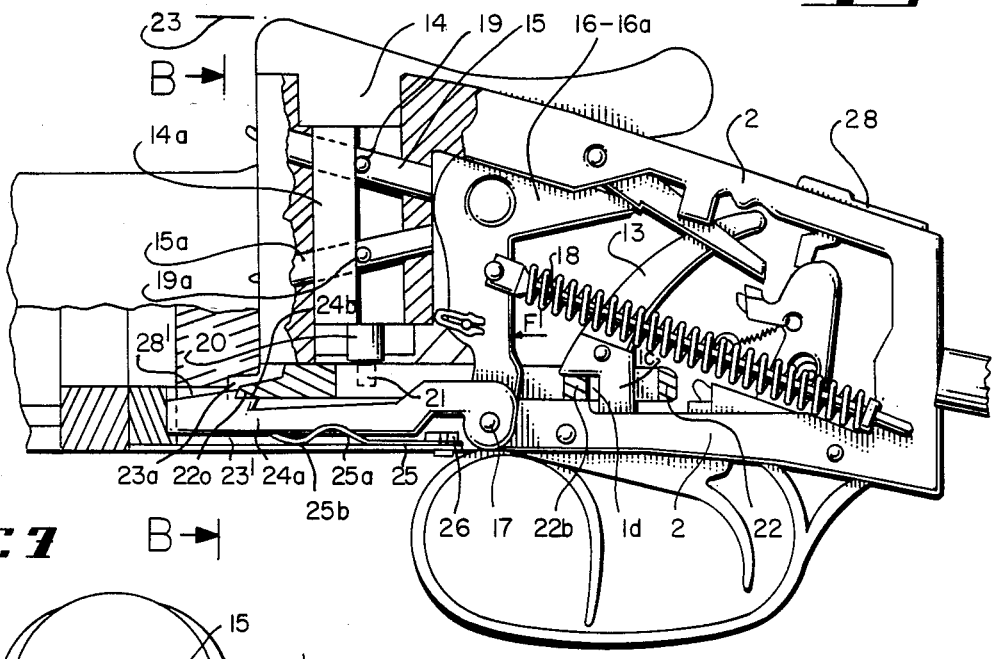
Fig. 7
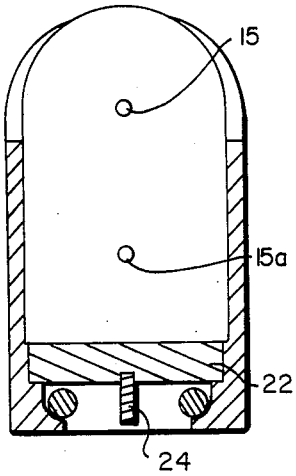
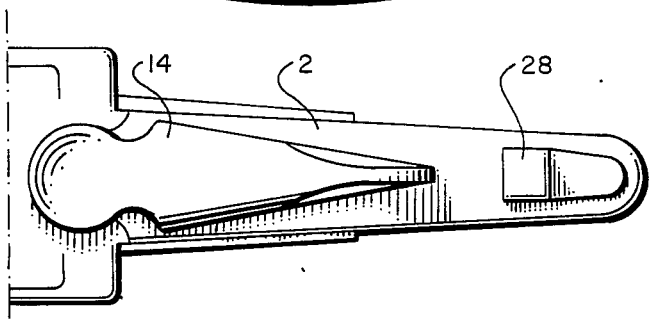
Fig. 8
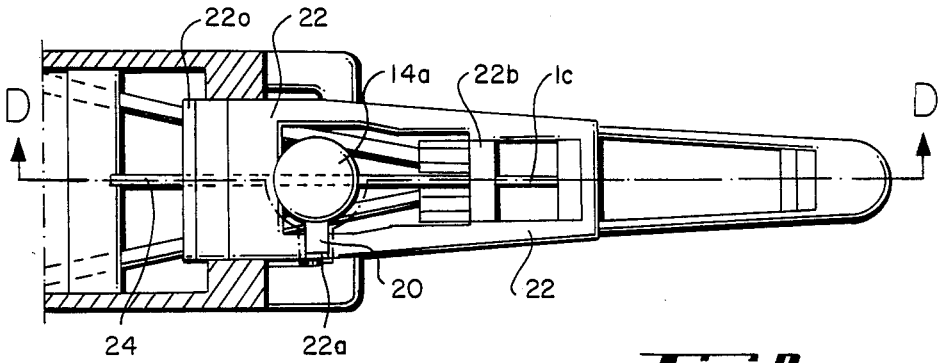
Fig. 9

BARREL AND INTERCHANGEABLE TRIGGER PLATE LOCKING DEVICE FOR SHOT GUNS

BACKGROUND OF THE INVENTION

1. Field of the Invention

This invention relates to an interchangeable barrel and trigger plate locking device, controlled by the top lever, for shotguns.

2. Description of Prior Art

It is well known to equip shotguns with interchangeable trigger plates, including the trigger and firing pin mechanism.

As the case may be, the user can therefore use and adapt to the receiver either a trigger plate with two separate triggers, or another trigger plate with only one selective trigger.

These trigger plates are locked in position by an independent mechanism, located behind the trigger guard, or also through the safety of the gun located on the receiver tang.

SUMMARY

The purpose according to the invention, is to combine the barrel locking mechanism with the trigger plate locking mechanism, so that a release is only possible when the breech is dismantled from the receiver and when the hammers are uncocked.

According to another feature, the top lever enables, thanks to its lower end, the lengthwise movement of a sliding bolt, the front end of which engages into a cross recess in the breech for its locking, whereas its back part engages into another recess in a trigger plate extension.

According to another feature, the pivoting of the top lever enables in first angular position the backward movement of the bolt, for the unlocking of the breech and the locking of the trigger plate, for the opening of the shotgun, whereas a hinged lever comprises a catch which cooperates with the front end of this bolt in order to block it.

According to another feature, the closing of the shotgun forces the breech, downwardly against the spring loaded lever releasing the bolt, the bolt is returned to the front for simultaneous locking of breech and trigger plate; this motion of the bolt is controlled by a second stepped front notch on this lever, and by the axial positioning of the top lever tang.

According to another feature, the dismantling of barrels from the receiver enables the finger access of lever for the manual release of the second notch, to allow the sliding to the extreme front position of the bolt for releasing its rear part from the trigger plate recess for dismantling, this positioning is also controlled by the extreme and opposed angular position of the top lever tang.

These objects, features and other advantages will become apparent from a consideration of the following description.

BRIEF DESCRIPTION OF THE DRAWINGS

In order to clarify the object of the invention, without limiting it, in the appended drawings:

FIG. 6 is a longitudinal section along line D—D of FIG. 9, illustrating shotgun closed after firing in position of double locking of breech and trigger plate.

FIG. 7 is a profile view in cross section through B—B line of FIG. 6.

FIG. 8 is an external top view corresponding to FIG. 6.

FIG. 9 is a plan view and longitudinal section through A—A line of FIG. 6.

DETAILED DESCRIPTION

Figure 1:
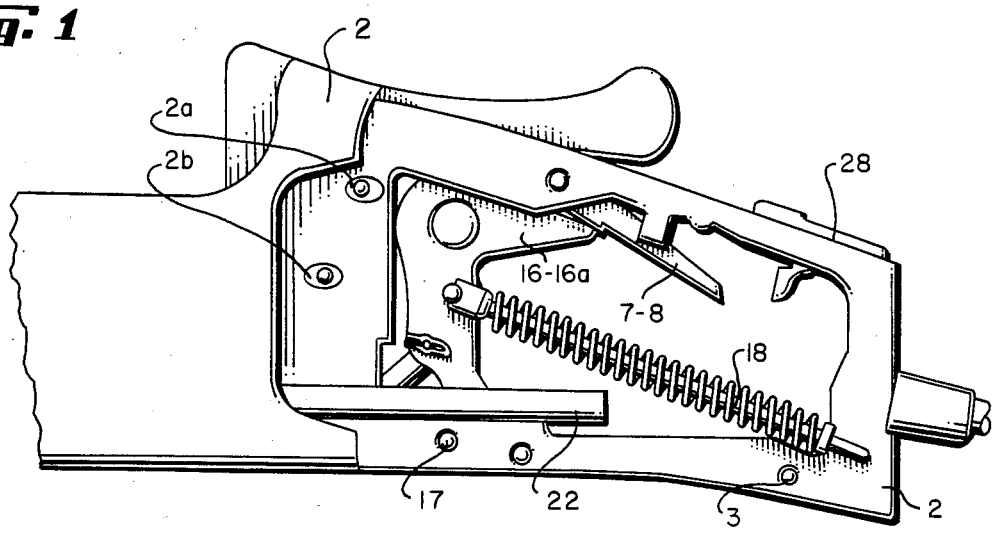
FIG. 1 is a front view of a shotgun receiver fitted with the double lock action according to the invention; the trigger plate is removed.

In order to make the scope of the invention more concrete, it is now described as a non limitative embodiment illustrated in the drawings This interchangeable barrel and trigger plate locking device according to the invention, is made from a standard trigger plate (1), that is shaped with a flat top section (1*a*) destined to be fitted in the mating opening in the receiver tang (2). To this effect, this section (1*a*) is shaped, at rear end, with a round recess (1*b*) centered and pivoted around a cross pin (3) through the receiver tang.

The trigger plate (1) top part is shaped with a raised boss profile (1*c*) with a front hook (1*d*) to co-operate with the double acting lock.

Figure 2:
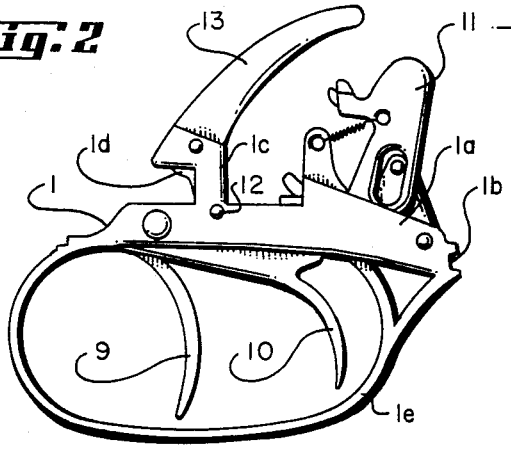
FIGS. 2 and 4 are front views of trigger plates adaptable to the receiver shown FIG. 1. One of the trigger plates is fitted with two separate triggers, whereas the other trigger plate is fitted with a single selective trigger.
Figure 4:
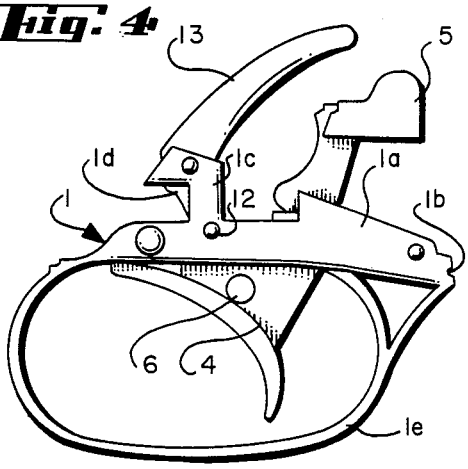
Figure 3:
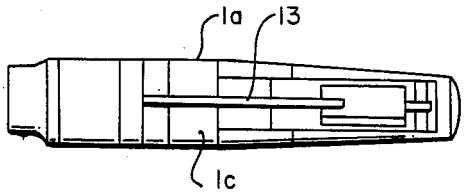
FIGS. 3 and 5 are respectively plan views corresponding to FIGS. 2 and 4.
Figure 5:
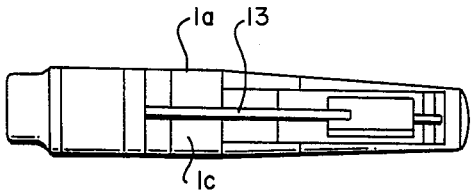
Figure 10:
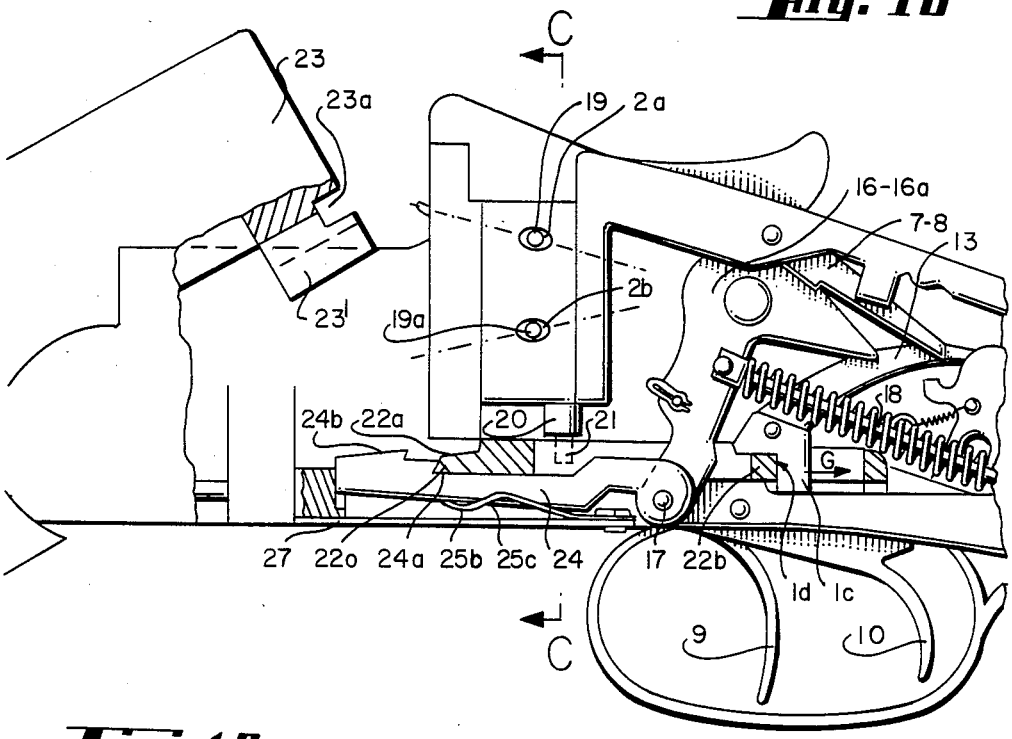
FIG. 10 is a view similar to FIG. 6, but the gun is shown open, whereas the trigger plate is locked.

The trigger plate by assuming the shape of a trigger guard may indifferently be fitted either with a single trigger (4) (FIG. 4) or separate triggers (FIG. 2). A single trigger guard is provided with weight (5) which can be moved crosswise by means of a control button (6) to come in front of the tang of either sear (7 and 8) centered on the upper part of the receiver (2). Separate triggers (9 and 10) are actuated separately through their respective connecting arm (11) contacting the aforesaid sear tangs (7 and 8). One may note that in the latter case of separate triggers, (9 and 10), it is also possible to adapt a first double-acting trigger.

One will also note that in any case, the boss (1*c*) will allow the articulation around a pin (12) of a central pushing lever (13) which induces the automatic return to the safety position when unlocking the gun as hereafter explained.

On the other hand, one has to underline that the trigger plate (1) does not have any firing pin mechanism.

Thanks to its vertical housing, the receiver allows the free rotation centering of the pin (14*a*) of the top lever (14) double lock.

This pin (14*a*) is provided with a recess in the height to clear the superimposed firing pins (15 and 15*a*) guided longitudinally in the receiver body (2) respectively actuated at the rear by pivoting hammers (16 and 16*a*). The latter are articulated on a common shaft (17) across the tang of the receiver (2), separately returned by springs (18) during firing.

One has to considerer that each firing pin (15–15*a*) takes diametrally a cross pin which crosses by its projecting ends an elongated recess (2*a*–2*b*) in the receiver. These pins (19 and 19*a*) are urged by the rotation of the top lever shaft (14*a*) only when unlocking the breech with a view to moving back the firing pins to clear their striking ends. The lower end of shaft (14*a*) of the top lever (14) is provided with a groove to take an eccentric lever (20) the projecting part of which is fitted with a prominent finger (21) engaging into a cross slot (22*a*) in the bolt (22).

The bolt (22) assumes the shape of a flat plate of longitudinally profiled shape, sliding at rear on the tang of the receiver (2) and is guided in front in an opening of mating section in the receiver wall so as to project with its end thus forming a nose (22*o*) engaging in a cross slot (23*a*) at the end of the breech (23).

The rear of bolt (22) is provided with a recess so as to allow the hammers (16 and 16*a*) to become engaged and to pass therein, as well as the profiled boss (1*c*) of the trigger plate (1). A cross bar (22*b*) provided in the recess of the bolt (22) co-operates with the front hook (1*d*) of the trigger plate, so as to lock it in position.

One has to consider that this bolt (22) is stopped at the front by one of the two notches (24*a*–24*b*) provided on the front face of a top lever retaining lever (24) arranged axially below the lock front part and articulated at rear on the shaft (17) of the hammers (16 and 16*a*).

This retaining lever (24) is urged upwardly by a spring blade (25), the rear end of which is fixed by a screw (26) to the receiver (2). The front end of the spring blade successively forms an axial support tongue (25*a*) resting on the lower face of the lever (24), and two symmetrical profiled legs (25*b*) arranged on either side, the round parts (25*c*) of which rest on a cover plate (27) fixed by the screw (26).

Figure 12:
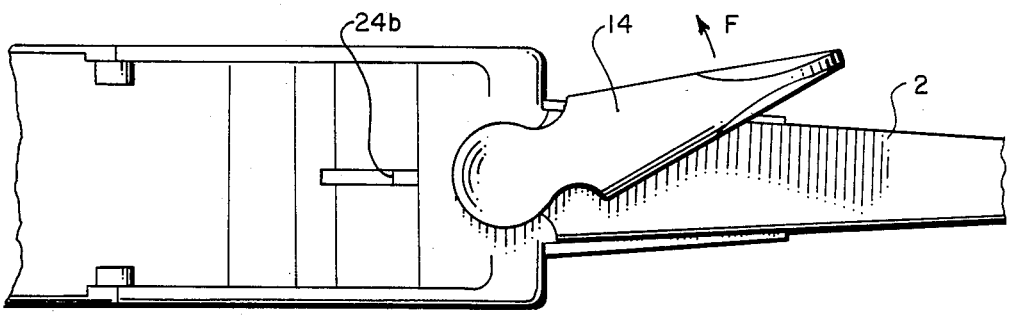
FIG. 12 is an external top view corresponding to FIG. 10.
Figure 11:
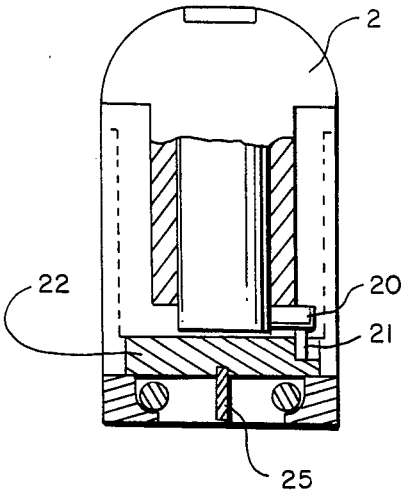
FIG. 11 is a profile view in cross section through C—C line of FIG. 10.

According to these arrangements, it is suitable to explain the working principle of this device. When opening the gun, the top lever (14) is pivoted to the right according to arrow F of FIG. 12, so as to allow, the slight backward movement of the firing pins (15 and 15*a*) to clear their front ends from the breech (23). The bolt (22) is also moved backward according to arrow G so as to clear its nose (22*a*) from the groove (23*a*) in order to unlock the breech (23) and to engage the cross bar (22*b*) into the front lug (1*d*) of the trigger plate for locking it. This angular position of the top lever is maintained by the engagement of the rear notch (24*a*) of lever (24) into the nose (22*a*) of the bolt (22), thus forming a stop.

One must note that the backward movement of the bolt (22) also allows through its cross bar (22*b*) a pressure on to the control lever (13) which pivots to the rear around its pin (12) and actuates, by its upper part, the slider (28) of the safety located on the receiver tang (2), pushing it to control the clearance of the weight (5) or of the connecting arms (11) from the sear tangs (7 and 8) thereby preventing any possibility of firing.

The tipping movement of the barrel holding breech (23) causes in a known manner, the pivoting to the rear of the hammers (16 and 16*a*) against their springs (18) until they are cocked by engagement with the sears (7 and 8).

When closing the gun, as illustrated FIG. 6, the breech (23) will straddle with its axial slot (23-1) the thickness of the top lever retainer (24) and allows it at the end of the closing stroke to pivot towards the bottom thereby pressing on to the axial tongue (25*a*) of the spring blade (25) so as to clear the rear notch (24*a*) from the nose (22*o*) of the bolt (22).

In this way, the bolt (22) is automatically returned towards the front through the top lever return spring, so as to allow the locking of the breech following the engagement of the nose (22*o*) of the bolt (22) into the groove (23*a*).

This locking position is limited by the engagement of the upper front notch (24*b*) of retainer (24) into the nose (22*o*) of the bolt.

One must consider that this forward movement of the bolt (22) according to the arrow ($F^1$) allows the positioning of the upper gripping lever of the top lever (14) along the axis of the receiver tang, whereas the cross bar (22*b*) of the bolt (22) remains engaged at rear in the front lug (1*d*) of the trigger plate, thereby locking it in position as previously.

One can also notice that the front part of the bar (22*b*) of the bolt is locked by the hammers (16 and 16*a*) which are in cocked position, thus making impossible the dismantling of the trigger plate.

In order to dismantle the trigger plate (1) for replacing the firing characteristics, as indicated before, the breech (23) is removed from the receiver (2) once the fore-end of the gun has been removed in a known manner, while the hammers (16 and 16*a*) are uncocked.

Figure 13:
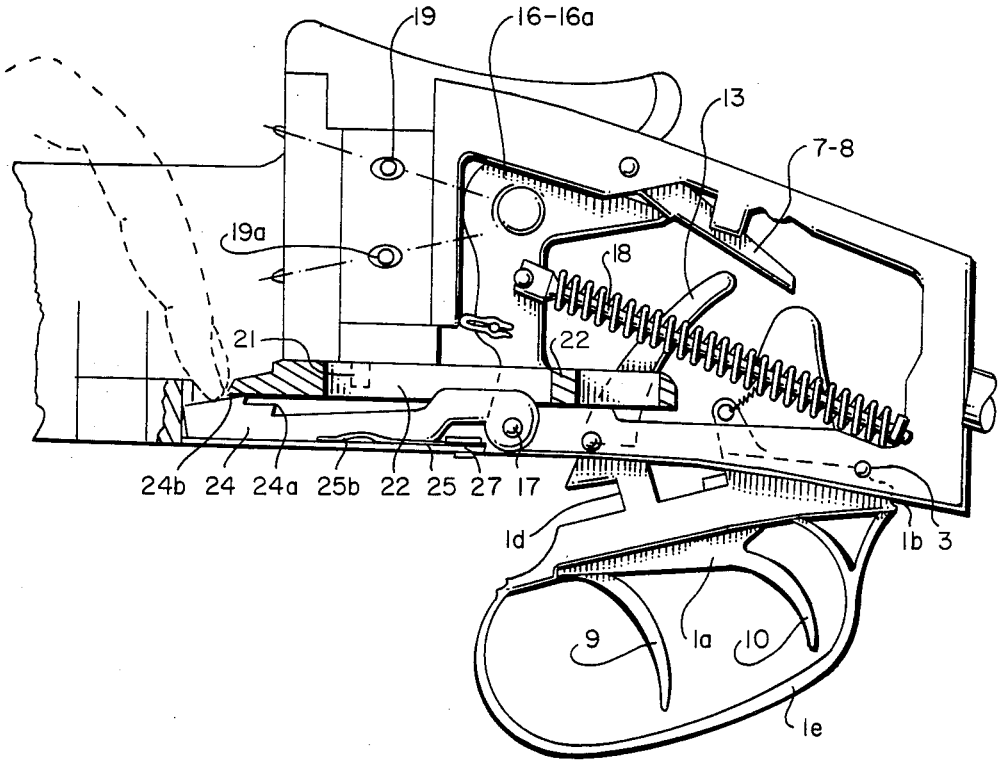
FIG. 13 is a longitudinal section through the uncocked shotgun; the barrel holding breech is removed for unlocking and trigger plate extraction.

Thus, the inside of the receiver is accessible to the finger of the user, as illustrated in FIG. 13, to push directly on to the front part of top lever retainer (24).

It is important to consider that this pressing with the finger on to retainer (24) requires a greater force, and is therefore absolutely voluntary and controlled. In fact, the pivoting action of the said retainer (24) must, on one hand, overcome the elastic resistance offered by the axial tongue (25*a*) of the spring (25) and, on the other hand, the elastic resistance offered by the symmetrical legs (25*b*), the round parts (25*c*) of which rest on a plate (27) owing to the greater pivoting amplitude towards the bottom of the retainer (24) due to the upward stagger of its stepped notches (24*a* and 24*b*).

Figure 14:
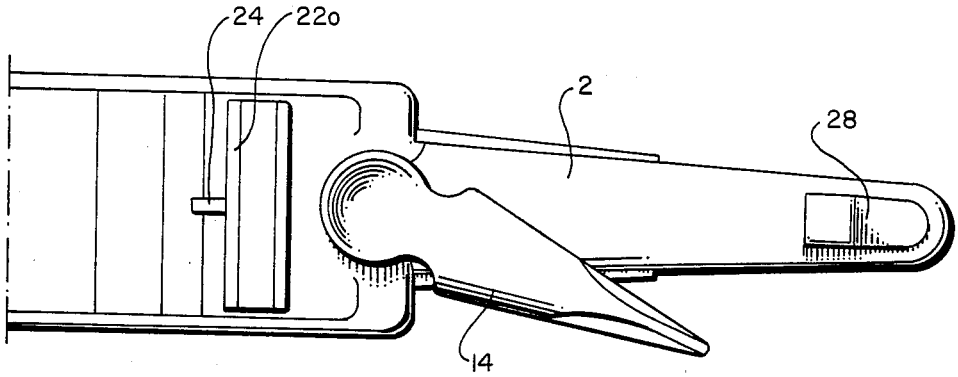
FIG. 14 is an external top view corresponding to FIG. 13.

After this release, the bolt (22) is freely returned to the front of the gun through the retainer return spring, the upper gripping lever of which is in angular position, symmetrical and opposed to the unlocking position, as illustrated in FIG. 14. In its forward movement, the bolt (22) releases entirely its bar (22*b*) from the front lug (1*d*) of the trigger plate (1), while the rear cross end pushes the sloping rear face of the profiled boss (1*c*) for allowing a slight pivoting movement of the recess (1*b*) of the trigger plate body (1) on the pin (3), thus facilitating its release. One has to consider that installing a trigger plate body fitted with a different trigger system is carried out conversely by positioning the recess (1*b*) on the pin (3), while the boss profile (1*c*) engages between the legs of the bolt (22) between its rear side and the bar (22*b*).

The advantages will become apparent from the description. The following is particularly underlined:

the permanent bolting of the trigger plate assembly (1), in opening and bolting position of the breech.

the permanent bolting of the trigger plate assembly (1) in cocking position of hammers, combined with the setting of the trigger safety to the "on" position.

the possibility of dismantling the trigger plate assembly only when the breech is removed, and when a positive pressure is manually applied on to the top lever retainer.

easy dismantling and installing.

While the invention has been described with particular reference to a specific embodiment, it is to be understood that it is not limited thereto, but is to be construed broadly.

I claim:

1. A bolting device for guns and the interchangeable trigger guard of sporting guns, comprising a receiver with a closing key (14) and a breech (23) integral with the gun, characterized in that the gun comprises a trigger guard body which permits the mounting of a single selective trigger or of separate triggers, which body comprises a flat base (1*a*) which fits into an opening in the receiver (2) and a projection (1*c*) with a front hook (1*d*) for cooperating with a back part of a double-action sliding bolt (22) whose front (22*o*) cooperates with a portion (23*a*) of the breech (23) during the closing of the gun, the closing key (14) is adapted and constructed for sliding the bolt (22), which can occupy distinct axial positions, a pivoting lever (24) comprises catches which cooperate with the front of the bolt (22) in order to hold it in these axial positions and that this lever is operatively coupled to an elastic return means (25).

2. Device according to claim 1, characterized in that the closing key (14) comprises a rotary shaft (14*a*) with axial return means corresponding to a bolting position for the arm and the trigger guard and that the shaft (14*a*) is provided with passages for the free passage of firing pins (15–15*a*) and support for transverse pins (19–19*a*) traversing the firing pins in order to reduce their recoil at the end of the travel of the rotating shaft of the key (14) corresponding to debolting of the breech (23).

3. Device according to claim 2, characterized in that the closing key (14) comprises a groove at the end of its rotary shaft (14*a*) for holding an extending lever (20) whose end is provided with a finger (21) that engages a transverse slot (22*a*) of the bolt (22) in order to permit its movement in translation.

4. Device according to claim 2, characterized in that when the gun is opened, the key (14) is adapted to pivot angularly in order to retract the firing pins (15) and also to effect the disengagement of the front (22*o*) of the bolt from the portion (23*a*) of the breech and, at the same time, to effect the engagement of a transverse bar (22*b*) on the bolt into the front hook (1*d*) of the trigger guard (1) in order to obtain locking, and that a limit stop position is effected by the engagement of a back catch (24*a*) of the lever (24) on the front (22*o*) of the bolt (22), stopping the key.

5. Device according to claim 1, characterized in that the lever (24) located axially at the base of the receiver (2) and below the bolt is articulated to a shaft (17) which also receives pivoting hammers (16, 16*a*), the lever is provided with two superposed and offset catches (24*a*, 24*b*) formed on an upper face of the lever which cooperate with the front of the bolt and that the back catch (24*a*) corresponds to a recoil position and a key stop position while the front catch (24*b*) corresponds to a bolting position of the breech.

6. Device according to claim 5, characterized in that the elastic return means of the lever (24) is a double-action leaf spring fixed to the receiver (2), that this spring comprises an axial tongue (25*a*) which rests on a lower face of the lever (24) opposite the back catch (24*a*) and two profiled branches (25*b*) in front located on each side with rounded parts (25*c*) resting on a covering plate (27) of the receiver and acting under flexing during front disengagement in order to permit debolting of trigger guard body (1).

7. Device according to claim 1, characterized in that the bolt (22) with a flat section slides longitudinally in an opening of the wall of the receiver (2) and comprises a profiled end in front (22*o*) which engages a groove (23*a*) of the breech (23), and a hollow in back for the passage of pivoting hammers (16, 16*a*) and of the projection (1*c*) of the trigger guard, whereas a transverse bar (22*b*) of the bolt cooperates, during the sliding of the bolt (22), with the front hook (1*d*) of the trigger guard body in order to assure its blocking.

8. Device according to claim 1, characterized in that the body of the trigger guard forms a rounded recess (1*b*) in order to center the trigger guard body on a transverse pin (3) transversing the receiver (2) and that the maximum advance of the bolt (22) permits the trigger guard body to be extracted because the projection (1*c*) is free from cooperating with the back part of the sliding bolt.

9. Device according to claim 1, characterized in that the projection of the trigger guard (1) permits the articulation and the circular guiding of a median push rod lever (13) regulated during pivoting by a transverse bar (22*b*) of the bolt (22) during its back travel in order to debolt the breech and that this lever acts on a safety slide (28) placed on the receiver.

10. Device according to claim 1, characterized in that during the closing of the arm, the breech (23) is adapted to act on the lever (24) in order to permit, at the end of travel, the disengagement of a back catch (24*a*) opposite the elastic return means (25) in order to free the bolt (22), which by the front (22*o*) of the bolt engages the portion (23*a*) of the breech and that a bar (22*b*) of the bolt is positioned inside the hook (1*d*), which remains bolted, whereas the front part of the bar (22*b*) is blocked by hammers (16, 16*a*) occupying a cocked position, whereby the bolt (22) occupies a position of the engagement at an upper front catch (24*b*) of the lever on the front (22*o*) of the bolt.

11. Device according to claim 1, characterized in that removing the breech (23) in relation to the receiver, the breech and receiver is adapted to (2) permits access to the lever (24) in order to pivot it manually against the resistance of the elastic return means (25) and that by pivoting of the lever (24) permits disengagement of an upper back catch (24*b*) of the lever returning the bolt (22) toward the front, which disengages a bar (22*b*) of the bolt from the hook (1*d*) of the trigger guard body (1), whereas the trigger guard body acts, when pushed, on the projection (1*c*) permitting the extraction of the trigger guard body (1) by pivoting about a pin (3) in the receiver.

* * * * *